United States Patent [19]

Tosti

[11] Patent Number: 4,506,901

[45] Date of Patent: Mar. 26, 1985

[54] CHILD'S CHARIOT

[76] Inventor: Luigi Tosti, 2363 Parent St., Windsor, Ontario, Canada, N8W 2E6

[21] Appl. No.: 424,428

[22] Filed: Sep. 27, 1982

[30] Foreign Application Priority Data

Sep. 22, 1982 [CA] Canada ..... 411931

[51] Int. Cl.[3] ..... A61G 5/02

[52] U.S. Cl. ..... 280/242 WC; 280/250; 280/289 WC; 297/DIG. 4; 188/2 F

[58] Field of Search ..... 280/211, 242 WC, 250, 280/289 WC; 297/DIG. 4; 188/2 F

[56] References Cited

U.S. PATENT DOCUMENTS

| | | | |
|---|---|---|---|
| 287,789 | 11/1883 | Arbogast | 280/211 |
| 305,061 | 9/1884 | Ellis et al. | 280/250 |
| 409,581 | 8/1889 | Harrell | 280/250 |
| 559,119 | 4/1896 | Carrick | 297/83 |
| 882,248 | 3/1908 | Haas | 280/211 |
| 1,600,131 | 9/1926 | Overton | 280/282 |
| 2,452,886 | 12/1947 | Wood | 280/250 |
| 3,052,486 | 9/1962 | Malmquist | 280/211 |
| 4,274,651 | 6/1981 | Dumont | 280/242 WC |
| 4,405,142 | 9/1983 | Whetstine | 280/242 WC |

FOREIGN PATENT DOCUMENTS

| | | | |
|---|---|---|---|
| 2532485 | 2/1977 | Fed. Rep. of Germany | 188/2 F |

*Primary Examiner*—Joseph F. Peters, Jr.
*Assistant Examiner*—Donn McGiehan
*Attorney, Agent, or Firm*—Moss, Hammond

[57] ABSTRACT

A hand-propelled chariot or vehicle is shown which is particularly useful for crippled individuals. The chariot has a frame having a seat portion, a seat back and left and right side arms, and an extended front foot platform. Rear wheels support the seat portion relatively close to the ground, and the height of the front foot platform is about half the height of the seat portion giving the chariot a low profile to facilitate mounting and dismounting by a crippled person. Hand crank operated, chain and sprocket, direct drives are connected to each rear wheel to turn same in either direction. Castors are mounted to support the front foot platform and permit the chariot to turn. A friction brake is connected to the rear wheels to hold the chariot steady during mounting and dismounting.

5 Claims, 3 Drawing Figures

CHILD'S CHARIOT

BACKGROUND OF THE INVENTION

This invention relates to a hand-propelled chariot or vehicle, which is particularly useful for paraplegics and especially crippled children.

In the past, the most usual vehicle or means of transportation for paraplegics has been the conventional wheelchair. The conventional wheelchair is a four wheel vehicle having relatively large rear wheels and smaller front wheels. The front wheels are usually pivotally mounted, and may in fact be castors, so that the wheelchair can be turned or steered by independent rotation of the larger rear wheels. Typically, the larger rear wheels are turned by manual manipulation, and for this purpose, an outer concentric rim is sometimes mounted on the wheel and this is turned by hand to drive the vehicle.

A different type of self-propelled wheelchair is shown in U.S. Pat. No. 1,600,131, issued Sept. 14, 1926 to C. B. Overton. Although this patent is concerned with making the wheelchair foldable, the patent does show chain and sprocket drive mechanisms for each rear wheel.

A difficulty with the wheelchair-type vehicles, however, is that they tend to be unstable and can tip over backwards. Further, it is difficult for a crippled person to get into or out of the wheelchair, because the seat is too high and there are usually foot rests that get in the way. This is particularly a problem for crippled children. In fact, crippled children often cannot get into or out of existing wheelchairs without assistance.

SUMMARY OF THE INVENTION

The present invention is a hand-propelled chariot having an extended lower front foot platform for easy access even by a crippled child.

According to the invention, there is provided a child's chariot comprising a frame having a seat portion, a seat back and left and right side arms. A pair of rear wheels is rotatably connected to the frame to support the seat portion above a ground surface. The frame includes an extended lower front foot platform, the foot platform being located vertically generally half way between the seat portion and the ground surface. A pair of front wheels is rotatably connected to the extended front foot platform, the front wheels being mounted to pivot about vertical axes. Also, drive means are operably connected to each rear wheel, the drive means including hand cranks located respectively adjacent to the left and right side arms forward of the seat portion.

BRIEF DESCRIPTION OF THE DRAWINGS

A preferred embodiment of the invention will now be described, by way of example, with reference to the accompanying drawings, in which.

DETAILED DESCRIPTION OF THE PREFERRED EMBODIMENT

Figure 2:
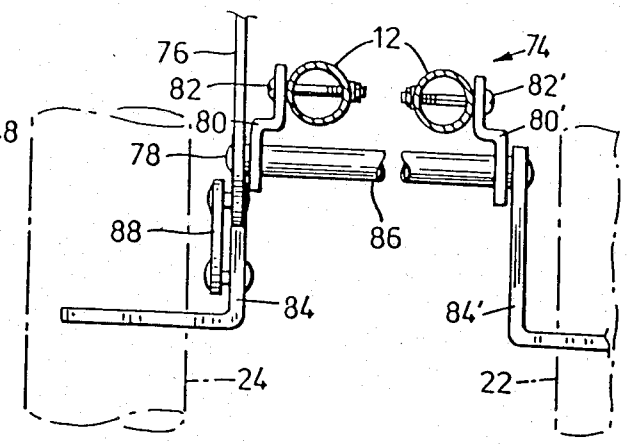
FIG. 2 is a view taken along lines 2—2 of FIG. 1, showing the brake mechanism of the chariot shown in FIG. 1.

Referring to the drawings, a preferred embodiment of a child's chariot according to the present invention is generally indicated by reference numeral 10. Chariot 10 has a frame 12 which includes a seat portion 14, a seat back 16, and left and right side arms 18, 20. Frame 12 is of welded tubular construction, being formed of $\frac{3}{4}$ inch diameter steel tubing, subsequently chrome plated or painted, as desired. Seat portion 14 has a conventional upholstered padded or cushion type seat.

A pair of rear wheels 22, 24 are rotatably connected to frame 12 to support seat portion 14 above a ground or floor surface. In this specification, the term "ground surface" includes a floor, a ramp, a deck, or any other surface on which chariot 10 is used. Wheels 22, 24 are mounted on frame 12 by being held between forks 26, 28 having outer members 30 and inner members 32. Inner members 32 are downwardly extending plates welded to frame 12. Outer and inner members 30, 32 have slotted lower end portions 34 into which rear wheel axles 36 are located in a manner similar to conventional bicycle construction. Conventional chain tensioners (not shown) are connected between the inner fork members 32 and axles 36 in a manner similar to conventional bicycle construction to move the wheels 22, 24 vertically and adjust the drive chain tension as described further below. Axle nuts 38 retain wheels 22, 24 in position in a conventional manner. Fenders 40 are connected to forks 26, 28, also in a manner similar to conventional bicycle construction.

Rear wheels 22, 24 are standard bicycle wheels, typically of a nominal size of $1\frac{3}{4}$ inch width by 16 inch diameter, with pneumatic tires mounted on spoked rims. Inner, driven chain sprockets 42 are attached to the hubs of the wheels to turn or drive same as described next below.

Drive means are provided to independently and directly drive or turn rear wheels 22, 24. The drive means include drive sprockets 44, driven sprockets 42, and bicycle chains 46 connecting the drive and driven sprockets. Chain guards or housings 48 enclose the drive sprockets 44 and chains 46 to protect the person using chariot 10. Chain guards 48 are typically of two piece construction bolted together so that they may be opened for access to sprockets 44 and chains 46.

Figure 1:
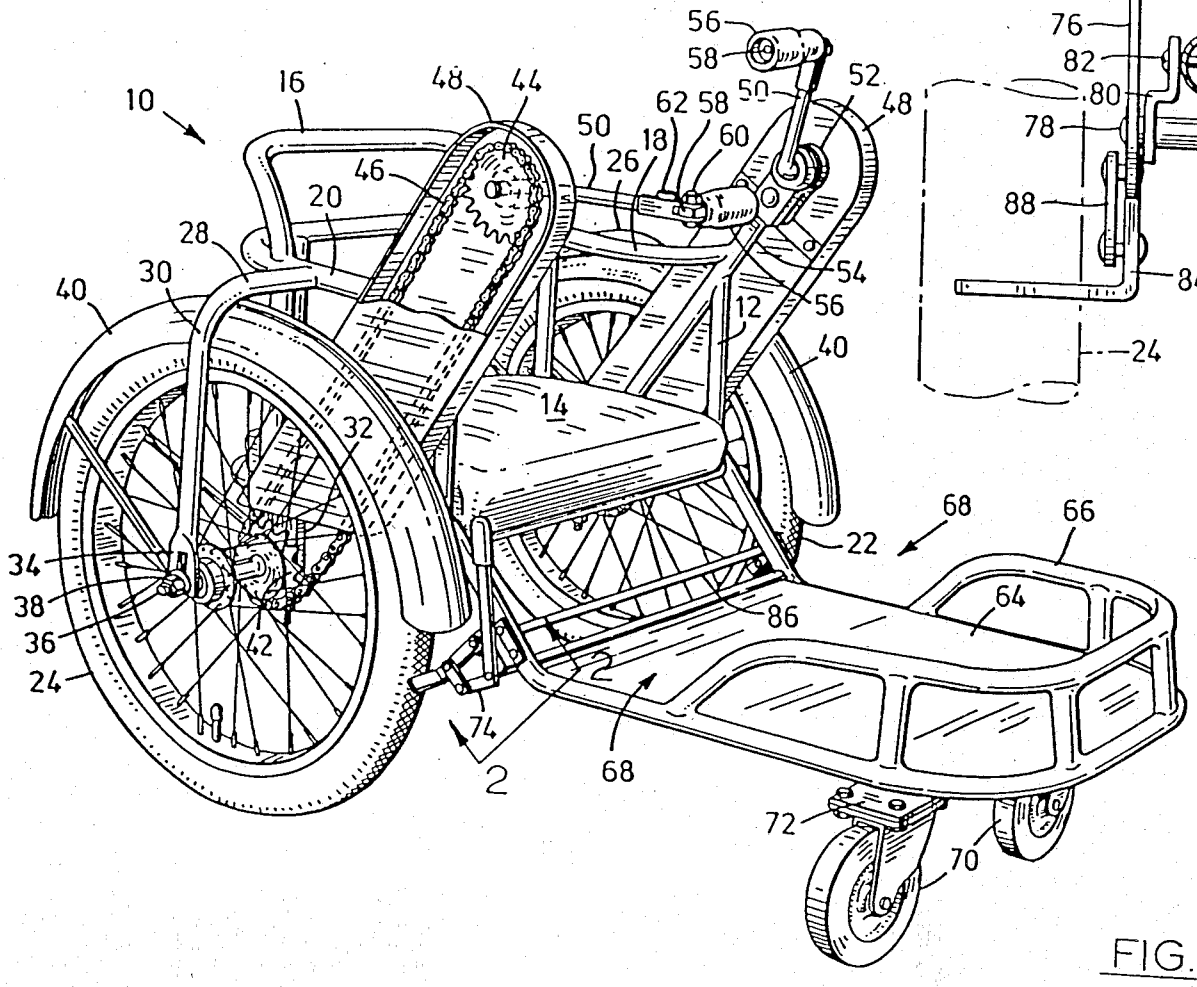
FIG. 1 is a perspective view, partly broken away, of a preferred embodiment of a child's chariot according to the present invention.

The drive means also include hand cranks 50 which are attached to drive sprockets 44 in a conventional manner using keyways or set screws, or both. Hand cranks 50 are mounted in bearings 52, which are in turn mounted on upwardly and forwardly extending tubular members 54 extending from left and right side arms 18, 20. Hand cranks 50 are thus located rrespectively adjacent to left and right side arms 18, 20 forward of seat portion 14. Hand cranks 50 include handles 56, which are rotatably retained on central axial shafts 58. Axial shafts are pivotally mounted in the hand cranks 50 by threaded fasteners 60, so that the handles 56 can swing away towards the outside of chariot 10 to facilitate the entry into the seat by a person using chariot 10. Handles 56 are retained in position by spring loaded detents 62 which engage axial shafts 58 and retain same in the transverse operative position shown in FIG. 1.

Frame 12 includes an extended lower front foot platform 64, which is located vertically generally half way between seat portion 14 and the ground or floor surface upon which chariot 10 rests. Foot platform 64 includes a low-profile railing 66 partially extending around the periphery of foot platform 64. The railing 66 is thus spaced from seat portion 14 to define access openings 68 on either side of foot platform 64. The access openings 68 facilitate the mounting of chariot 10, since they permit a paraplegic child, for example, to crawl up onto foot platform 64 and then up onto the seat of chariot 10 without having to reach or climb too high.

A pair of front wheels or castors 70 are rotatably connected to the extended front foot platform 64 adjacent to the forward end thereof. The castors 70 are thus mounted to pivot about vertical axes allowing chariot 10 to turn as the rear wheels 22 are rotated in different directions or at different speeds. Chariot 10 turns easily because the rear wheels 22 are substantially larger in diameter than the front wheels or castors 70. Front castors 70 are typically 4 inch diameter swivel castors and they are attached to front foot platform 64 in a conventional manner, such as by being connected to transverse plates 72 welded to the peripheral tubular portion of foot platform 64.

Figure 3:
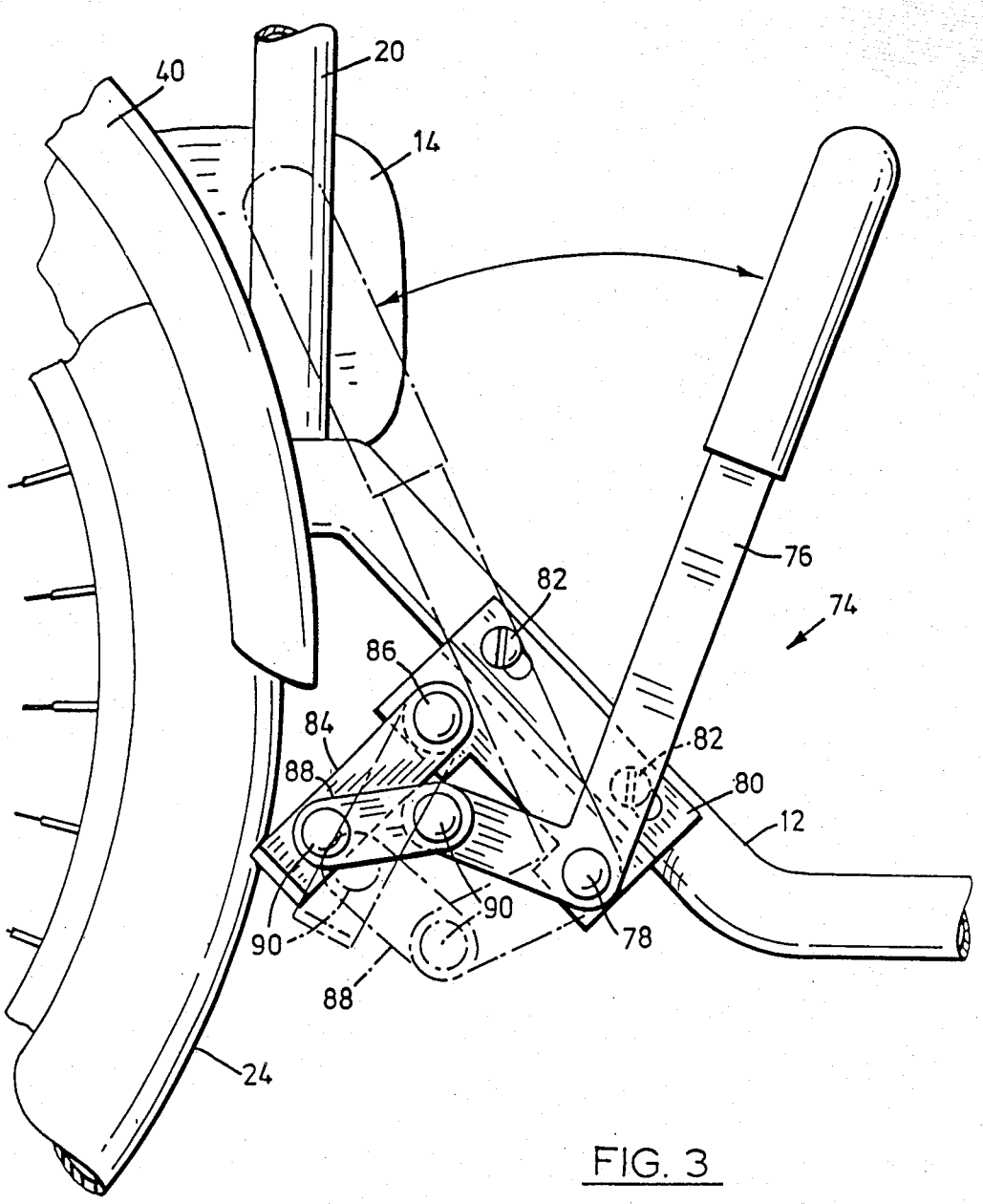
FIG. 3 is a side elevational view of the brake mechanism of the chariot shown in FIG. 1, showing the operation of same.

A friction brake 74 is mounted on frame 12 to engage rear wheels 22, 24. As seen best in FIG. 3, friction brake 74 includes a handle 76 which is pivotally connected by a pin or rivet 78 to a bracket 80 attached to frame 12 by threaded fasteners 82. A tire engaging member 84 is also pivotally connected to bracket 80 by a cross shaft 86. A link 88 is pivotally connected by pins or rivets 90 to tire engaging member 84 and handle 76 to form an over-the-centre toggle linkage for locking the brake and preventing the rear wheel 22 from turning. As seen best in FIG. 3, when handle 76 is pushed forward as shown in solid lines, the brake is locked on to engage the tire of rear wheel 24 and prevent same from turning. When the handle 76 is pulled back as shown in chain dotted lines, the brake is released to permit rear wheel 24 to turn freely.

As seen best in FIG. 2, friction brake 74 also includes a left hand tire engaging member 84' which is connected to cross shaft 86 and is pivotally mounted in a bracket 80', as in the case of tire engaging member 84 and bracket 80. Bracket 80' is held in position by threaded fasteners 82'. Since both tire engaging members 84, 84' are securely connected to cross shaft 86, when the friction brake 74 is applied by moving handle 76 forward, both tire engaging members 84, 84' engage the respective rear wheels 22, 24 and prevent same from turning.

Having described a preferred embodiment of the invention, it will be appreciated by those skilled in the art that various modifications may be made to the structure described. For example, the chain and sprocket drive means could be replaced by other drives, such as V-belts and pulleys or sheaves, or timing belts and timing gears, as desired. Front foot platform 64 is described as being appoximately half way in vertical height between seat portion 14 and the ground or floor surface. The height of foot platform 64 could be varied somewhat. Different types of brake mechanisms could be used to prevent rear wheels 22, 24 from turning. If desired, separate brakes could be used on each rear wheel. Further, although frame 12 has been described as being of tubular construction, it will be appreciated that the frame could be of different form, such as a moulded unitary body or the like. In this specification, the term "frame" is intended to include all types of chassis or bodies. Finally, in place of the padded seat portion 14 and seat back 16, or in addition to these parts of the seat, special moulded supports or jackets, or braces or prosthetic devices, or a seat belt could be used, as desired.

From the above, it will be appreciated that the chariot of the present invention is a very versatile vehicle especially useful for paraplegics due to the ease with which the chariot may be mounted and dismounted. The direct drive means connected to each rear wheel makes the chariot extremely maneuverable, since selective turning of the hand cranks can cause the chariot to turn or move in any direction. Further, the extended front foot platform and the low profile of the chariot gives it extremely high stability, which is important for use by paraplegics.

What I claimed as my invention is:

1. A child's chariot comprising:

a frame having a seat portion, a seat back and left and right side arms;

a pair of rear wheels rotatably connected to the frame to support the seat portion above a ground surface;

the frame including an extended lower front foot platform, the foot platform being located vertically generally half way between the seat portion and said ground surface, the front foot platform including a low profile railing partially extending around the periphery of the foot platform, the railing being spaced from the seat portion to define access openings on either side of the foot platform;

a pair of front wheels rotatably connected to the extended front foot platform, the front wheels being mounted to pivot about vertical axes; and drive means operably connected to each rear wheel, the drive means including hand cranks located respectively adjacent to said left and right side arms forward of the seat portion.

2. A child's chariot as claimed in claim 1 wherein said front wheels are swivel castors.

3. A child's chariot comprising:

a frame having a seat portion, a seat back and left and right side arms;

a pair of rear wheels rotatably connected to the frame to support the seat portion above a ground surface;

a friction brake means mounted on the frame to engage the rear wheels, the friction brake means including an over-the-centre toggle linkage for locking the brake and preventing the rear wheels from turning;

the frame including an extended lower front foot platform, the foot platform being located vertically generally half way between the seat portion and said ground surface, the front foot platform including a low profile railing partially extending around the periphery of the foot platform, the railing being spaced from the seat portion to define access openings on either side of the foot platform;

a pair of front wheels rotatably connected to the extended front foot platform, the front wheels being mounted to pivot about vertical axes; and drive means operably connected to each rear wheel, the drive means including hand cranks located respectively adjacent to said left and right side arms forward of the seat portion;

the drive means further including a drive sprocket connected to each hand crank, a driven sprocket connected to each rear wheel and chains connecting said respective drive and driven sprockets, so that the hand cranks are directly operatively coupled to the rear wheels.

4. A child's chariot as claimed in claim 3 wherein said hand cranks include swing-away, pivotally mounted handles and detent means for engaging and retaining the handles in transverse operative position.

5. A child's chariot as claimed in claim 4 wherein said rear wheels are substantially larger in diameter than said front wheels.

* * * * *